US009539735B2

(12) United States Patent
Ferguson et al.

(10) Patent No.: US 9,539,735 B2
(45) Date of Patent: Jan. 10, 2017

(54) METHODS AND APPARATUS FOR ELASTIC DEACTIVATION IN A LAMINATE

(71) Applicant: Curt G. Joa, Inc., Sheboygan Falls, WI (US)

(72) Inventors: Ryan Ferguson, Howards Grove, WI (US); Dennis Faucher, Sheboygan, WI (US); Robert E Andrews, Sheboygan, WI (US); Gottfried J Hohm, Sheboygan Falls, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 0 days.

(21) Appl. No.: 14/737,272

(22) Filed: Jun. 11, 2015

(65) Prior Publication Data

US 2015/0360380 A1 Dec. 17, 2015

Related U.S. Application Data

(60) Provisional application No. 62/010,758, filed on Jun. 11, 2014.

(51) Int. Cl.

| | |
|---|---|
| ***B26D 1/62*** | (2006.01) |
| ***B26D 7/26*** | (2006.01) |
| ***B26F 1/20*** | (2006.01) |
| ***B26D 1/40*** | (2006.01) |

(52) U.S. Cl.

CPC ..... *B26D 1/626* (2013.01); *B26D 1/405* (2013.01); *B26D 7/2628* (2013.01); *B26F 1/20* (2013.01); *Y10T 83/0515* (2015.04); *Y10T 83/7809* (2015.04)

(58) Field of Classification Search

CPC ..... B32B 38/10; B32B 38/00; B32B 38/04; B32B 37/14; A61F 13/15593; A61F 13/15739; A61F 13/1523; A61F 13/15772; A61F 13/15; A61F 13/19; A61F 13/15707; B23D 7/08; B26D 7/20; B26D 7/204; B26D 7/26; B26D 7/2628

USPC ..... 83/37, 699.51, 663, 698.61, 698.51,83/698.4, 344, 345, 659, 348, 357, 331, 346

See application file for complete search history.

(56) References Cited

U.S. PATENT DOCUMENTS

| | | | | |
|---|---|---|---|---|
| 3,174,372 | A * | 3/1965 | Huck | B26D 1/0006 83/110 |
| 4,412,467 | A * | 11/1983 | DeSanto | B26D 1/626 83/346 |
| 4,491,045 | A | 1/1985 | Buhayar | |
| 4,917,696 | A | 4/1990 | De Jonckheere | |
| 5,129,435 | A * | 7/1992 | Beuving | B27N 3/18 144/2.1 |
| 5,415,649 | A | 5/1995 | Watanabe et al. | |
| 5,449,353 | A | 9/1995 | Watanabe et al. | |
| 5,707,470 | A | 1/1998 | Rajala et al. | |

(Continued)

FOREIGN PATENT DOCUMENTS

| | | |
|---|---|---|
| EP | 1374814 B1 | 11/2014 |

*Primary Examiner* — Ghassem Alie

(74) *Attorney, Agent, or Firm* — Rya Kromholz & Manion, S.C.

(57) ABSTRACT

A variable interference anvil and knife combination is provided to selectively sever elastics in a laminate and preferably not sever the nonwoven portions of the laminate. The distance between the anvil and the knife can be programmatically altered to provide for smaller or larger gaps as processing speeds are changed.

11 Claims, 4 Drawing Sheets

(56) References Cited

U.S. PATENT DOCUMENTS

| | | | | |
|---|---|---|---|---|
| 6,244,151 | B1 * | 6/2001 | Machamer | B26D 7/2628 83/663 |
| 6,375,646 | B1 | 4/2002 | Widlund et al. | |
| 6,482,278 | B1 | 11/2002 | McCabe et al. | |
| 6,554,815 | B1 | 4/2003 | Umebayashi | |
| 6,605,173 | B2 | 8/2003 | Glaug et al. | |
| 7,708,849 | B2 | 5/2010 | McCabe | |
| 7,771,407 | B2 | 8/2010 | Umebayashi | |
| 7,777,094 | B2 | 8/2010 | Mori et al. | |
| 7,861,756 | B2 | 1/2011 | Jenquin et al. | |
| 7,909,956 | B2 | 3/2011 | Coose et al. | |
| 8,440,043 | B1 * | 5/2013 | Schneider | A61F 13/15723 156/160 |
| 9,028,632 | B2 | 5/2015 | Schneider et al. | |
| 9,039,855 | B2 | 5/2015 | Schneider et al. | |
| 9,050,213 | B2 | 6/2015 | LaVon et al. | |
| 2002/0046802 | A1 | 4/2002 | Tachibana et al. | |
| 2002/0184985 | A1 | 12/2002 | Ishibuchi et al. | |
| 2003/0111169 | A1 * | 6/2003 | Baggot | B31F 1/07 156/251 |
| 2005/0230037 | A1 | 10/2005 | Jenquin et al. | |
| 2006/0254698 | A1 | 11/2006 | Tachibana et al. | |
| 2009/0235800 | A1 * | 9/2009 | Germaine | B26D 5/00 83/659 |
| 2009/0283207 | A1 | 11/2009 | Tachibana et al. | |
| 2012/0086145 | A1 | 4/2012 | Nakamura et al. | |
| 2012/0167736 | A1 * | 7/2012 | Yokoe | B26D 1/405 83/348 |
| 2013/0255861 | A1 | 10/2013 | Schneider | |

* cited by examiner

METHODS AND APPARATUS FOR ELASTIC DEACTIVATION IN A LAMINATE

RELATED APPLICATIONS

This application claims the benefit of provisional application Ser. No. 62/010,758 filed 11 Jun. 2014, the entirety of which is incorporated herein by reference.

BACKGROUND OF THE INVENTION

This invention relates to precise repositioning of a knife surface relative to an anvil surface. Although the invention is described as most useful to deactivate elastic portions in stretch laminates containing elastic, the precise repositioning of two rotating surfaces can be applied in other manufacturing techniques and environments.

Disposable diapers are typically equipped with elastic strands in different areas of the product. Some applied elastics, such as leg elastics, encircle the leg-holes. Other elastics are applied across waistbands. These strands of elastic are typically captured with adhesive between two layers of non-woven materials. In areas where adhesive is applied during the laminate formation, elastic adheres to the laminate and is retained in position to provide a stretchable quality to the laminate. In areas where elastics are applied, but no adhesive is applied, the elastic is free to snap back in the laminate and provide areas of relative inelasticity in the laminate. In this fashion, disposable products can be applied with alternating areas of elasticity and inelasticity, for instance across a waistband.

In one method of manufacture, the diapers are produced in an orientation whereby product flow is in the form of a single continuous web and the direction of travel is at a right angle with respect to what would be described as the crotch line of the diaper, i.e., the normal direction of product flow is parallel to the waist as opposed to parallel to the crotch.

The shirring effect created by elastic strands when laminated with any flexible fabric is well known. However, to have this shirring effect applied to the crotch of a pant-type garment can be undesirable. The elastics create a contractile force, which tends to distort the garment's aesthetic appeal, effectiveness and comfort. Thus various methods of reducing or eliminating the effects of the elastic tension normally occurring at the crotch have been attempted. These methods include the elimination of the adhesive bond between the strands and the liner materials described in U.S. Pat. No. 5,745,922 as "unsecured space" as well as various methods of cutting the strands to eliminate their effects.

As mentioned, one method of eliminating the undesired effects of the elastic strands which cross the crotch region is to sever them. This method is described in U.S. Pat. No. 5,660,657. Unfortunately, such severing usually requires the introduction of a transversely extending cut, which can result in a loss of web tension in the severed part of the carrier web. This also creates an undesirable opening in the diaper backsheet. A proposed solution for this problem is taught in U.S. Pat. No. 5,707,470, wherein an ultrasonic device is used to sever the elastic members, while the carrier webs which encapsulate the elastics are left intact. See, also, U.S. Pat. No. 5,643,396. Another problem associated with such severing lies in the tendency of the unsecured severed ends of elastic to retract to some point beyond the limits of any adhesive pattern. Thus, the elastic strands are not controlled or anchored near the ends of the adhesion pattern and may snap back to further into the adhesive pattern. This results in an incomplete elastic pattern and poor product characteristics.

SUMMARY OF THE INVENTION

Elastic strands, ribbon, or scrim is laid down in a machine direction. Adhesive is applied either to the elastic material or a layer of a two-layer non-woven sandwich around the elastic in areas where elasticity is desired in an end product. Areas with desired inelasticity have no adhesive applied so the elastic is free to snap out of place. Elastic and inelastic zones can be formed in a non-woven, elastic, non-woven sandwich in front and rear portions of a diaper as a laminate.

A unit is capable of deactivating stretched elastics, preferably without cutting the material that the elastic is sandwiched between. A unit is disclosed to provide precise repositioning of a fast rotating knife surface relative to a fast rotating anvil surface. In particular, the elastic deactivation unit is a device built to deactivate stretched elastic that is sandwiched between two materials. This unit deactivates the elastics preferably without cutting the material.

This invention accomplishes deactivation by interacting with the material using a profiled blade and variable interference anvil. This profiled knife edge allows for sufficient force to deactivate the elastic while preferably not cutting the material. The amount of interference required for proper performance of the unit varies with many factors such as speed and material, and is electronically controlled.

A system or apparatus comprising according to the present invention includes a knife blade supported for revolution in a first direction about a knife axis and an anvil supported for revolution in a second direction about an anvil axis. The anvil has a working anvil surface facing away from the anvil axis. A nip occurs, having a nip gap formed at a nip position of the knife blade and working anvil surface during respective revolutions, the nip adapted to receive a web material. The nip gap is selectively variable by changing respective revolutional phase positioning of the knife and the anvil. That is, by changing the position of the knife about its revolution with respect to the anvil position or the position of the anvil about its revolution with respect to the knife position, or both. The first and second directions are preferably opposite (i.e., clockwise and counter-clockwise when viewed from the same angle).

According to an aspect of a system according to the present invention the knife axis and anvil axis may be at least substantially parallel to each other.

According to another aspect of a system according to the present invention, the anvil surface may include a working anvil surface length measured tangentially to the second direction, the working anvil surface length extending between a leading end and a trailing end.

In one embodiment, the knife blade is closest to the anvil axis in the nip position. The knife blade may have a blade edge extending parallel to the knife axis. The blade edge may have a cross-section perpendicular to the knife axis, the cross-section comprising a radius, of about 0.25 mm to about 10 mm with about 0.25 mm to about 6 mm being more preferred.

According to yet another aspect of a system according to the present invention, the working anvil surface may be sloped toward the anvil axis from the leading end toward the trailing end.

In a system having a revolving knife and a revolving anvil cooperating to form a nip, a method comprising according the present invention includes the step of changing a nip gap spacing between the knife and anvil by changing respective revolutional phase positioning of the knife and the anvil. The method may further comprise the steps of receiving a composite web in the nip, the web comprising at least three layers, and completely severing a middle layer (disposed between at least a first and second layer) without severing a first layer that contacts the knife and without severing a second layer that contacts the anvil.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
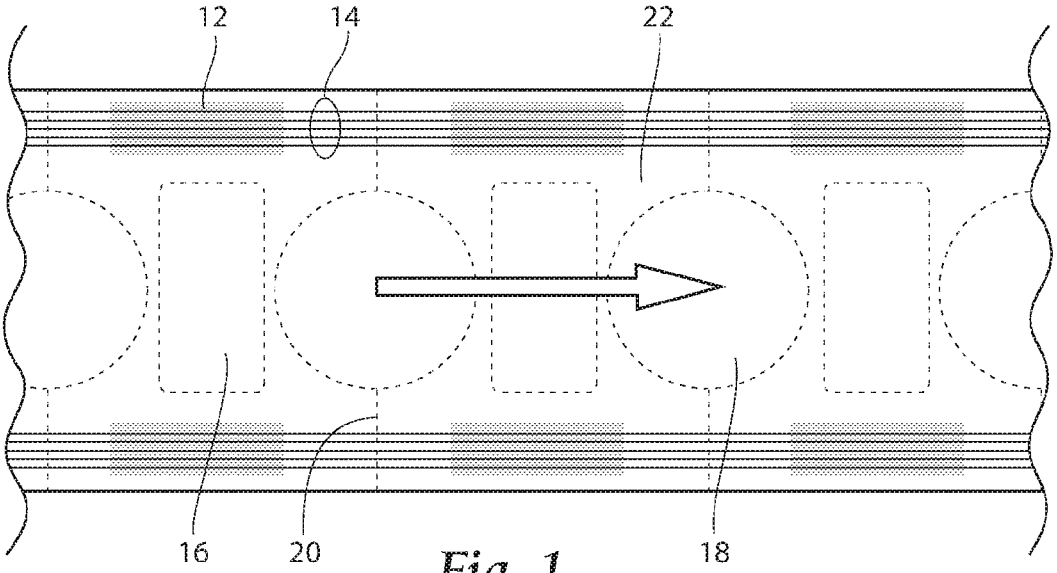
FIG. 1 is a top view of a pant type diaper during production, with elastic strands laid down over areas with and without adhesive in what will become front and rear portions of the diaper.

Referring now to FIG. 1 a top view of a pant type diaper during production is shown. Elastic strands 14 are laid down over areas with adhesive 12 and without adhesive between areas of adhesive 12, in what will become front and rear portions of the diaper. Typically, adhesive 12 is laid down with an intermittent adhesive applicator which is turned on and off as the web 22 migrates downstream, to create the zones of adhesive 12. As is typical, an absorbent core 16, leg cut outs 18, and side seam cuts 20 are provided to achieve the final diaper product after folding (not shown). Strands 14, ribbon, scrim, or a continuous layer of elastic can all be employed interchangeably.

Figure 2:
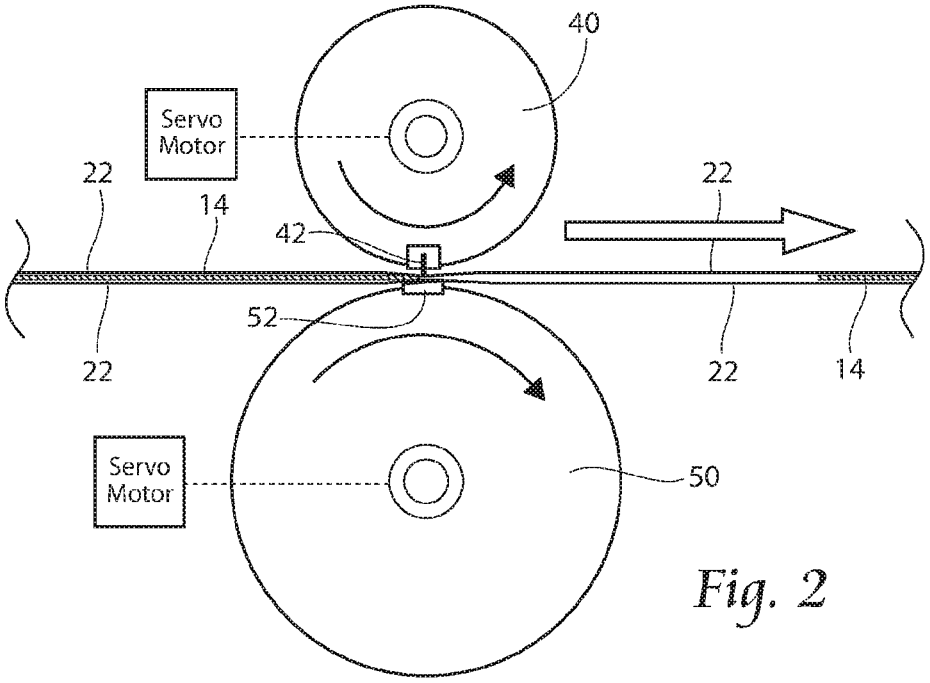
FIG. 2 is a view of a laminate sandwich entering a rotating profiled knife edge/variable interference anvil roll unit.
Figure 3:
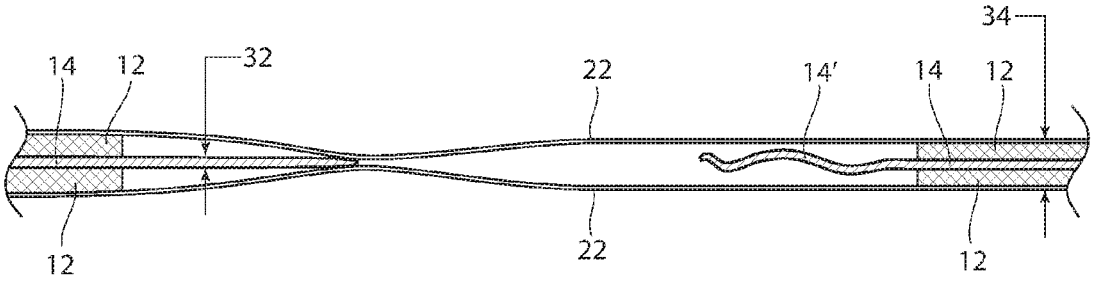
FIG. 3 is a side cross sectional view of the laminate before and after entering the rotating profiled knife edge/variable interference anvil roll unit.
Figure 4:
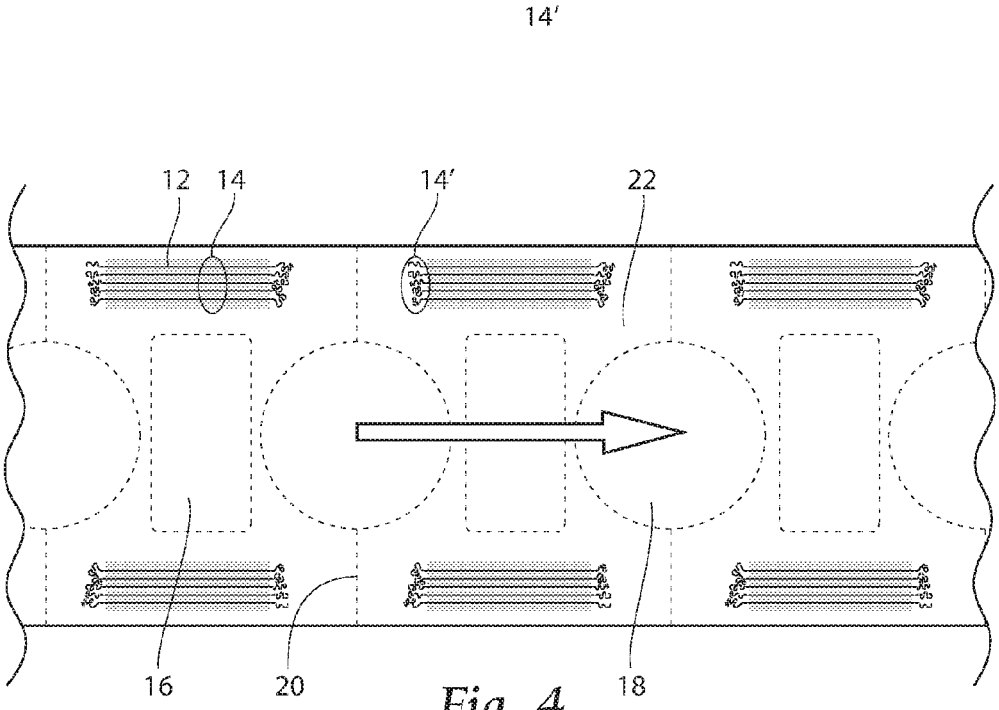
FIG. 4 is a top view of a pant type diaper during production, with elastic strands activated to create a shirring effect to create elasticized zones in what will become front and rear portions of the diaper.

Referring now to FIG. 2, a side view of web 22 (which can for instance be a laminate comprising nonwoven layers) sandwiching elastic 14 is shown entering into a rotating profiled knife roll unit 40 and variable interference anvil roll unit 50. Knife roll 40 carries knife 42 on knife insert 44. Anvil roll 50 carries a variable interference anvil 52. In the pictured embodiment, the knife roll 40 rotates in a counter-clockwise direction, and the anvil roll 50 rotates in a clockwise direction. The force of the knife 42 on the variable interference anvil 52 is enough to sever the elastic 14, but preferably not enough to sever nonwovens 22. As shown in FIGS. 3 and 4, the elastic 14 snaps out of zones without adhesive 12 leaving severed elastic 14', but elastic 14 remains in place in zones with adhesive 12 to provide elasticity in those zones.

Figure 5:
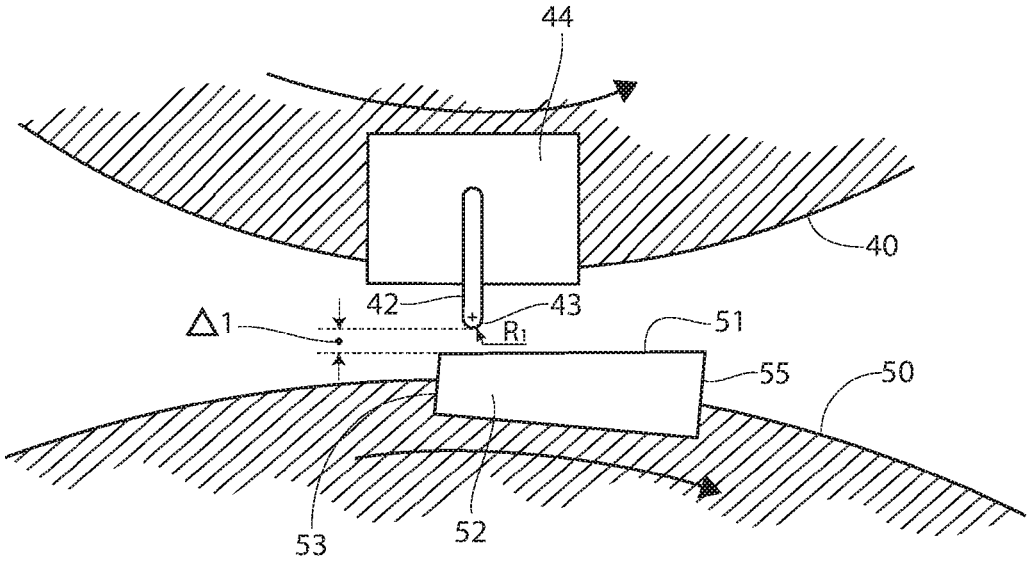
FIG. 5 is a closeup side view of a rotating profiled knife edge/variable interference anvil roll unit with a larger provided gap between the knife edge and anvil roll.

Referring now to FIG. 5, the rotating profiled knife 42 is shown, preferably with a relatively blunt tip or edge 43 to avoid or minimize severing web 22 (which, as indicated, can be a nonwoven). For instance, a radius R1 of approximately 0.25-6.0 mm can be used at the knife tip or blade edge 43, but more preferably, a radius R1 of approximately 0.25-6.0 mm may be used. Variable interference anvil 52 has a working anvil surface 51 is sloped between a lower trailing end 53 and a higher leading end 55. Between the ends 53,55, the working anvil surface has a length 57 measured parallel to a tangent of the revolutional path of the anvil 52. The slope of the anvil 52 preferably forms a linear relationship with the nip gap between knife 42 and anvil 52. For instance, for every millimeter along the length 57, a change in approximately 0.0005" of a nip gap (Δ) between knife 42 and anvil 52 is provided. That is, when the knife edge 43 is closest to the anvil axis, the knife 42 and a 52 may be said to be in a nip position.

Figure 6:
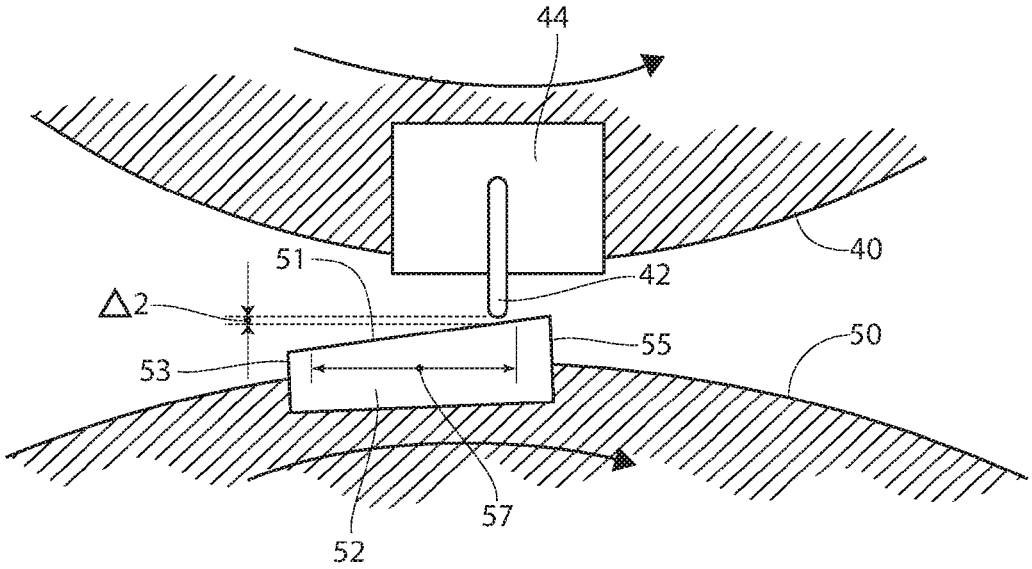
FIG. 6 is a closeup side view of a rotating profiled knife edge/variable interference anvil roll unit with a smaller provided gap between the knife edge and anvil roll.

By changing the position of the knife 42 relative to anvil surface 51, the gap Δ1 can be varied. For instance, as shown in FIG. 5, the knife 42 is positioned relatively near the trailing end 53 of the anvil 52, creating a larger gap Δ1. By positioning knife 42 relatively near the leading end 55 of the anvil 52, a smaller gap Δ2 is provided as shown in FIG. 6. At higher rotation speeds of the knife roll 40 and the anvil roll 50, it may be desirable to have a slightly larger gap Δ1 because less interference is required to deactivate elastic 14. At slower speeds, a smaller gap Δ2 may be desired. In other words, deactivation of elastics 14 requires less force at higher speeds, so the slightly larger gap Δ1 is preferred to minimize disruption of the web 22. Phase adjustments (relative rotational positioning) between knife 42 and anvil 52 can be varied to provide the right impact at a given speed.

Rotational positioning of the knife roll 40 (and thus the knife blade 43) relative to die anvil surface 51 may be done programmatically, such as by controlling servo drive motors that drive the rolls 40,50 respectively for instance by servo drive motors coupled to rolls 40 and 50 (see, e.g., FIG. 2). Adjustments may be made based on thickness 32 of elastics 14 or a thickness 34 of a composite web including the material members to be severed. In this way, accommodations may be made for machine speed or even variations or wear of components. For instance, if the blade 42 is wearing some, the knife 42 can be shifted to a relatively higher point on anvil 52 to return to the desired gap Δ.

Figure 7:
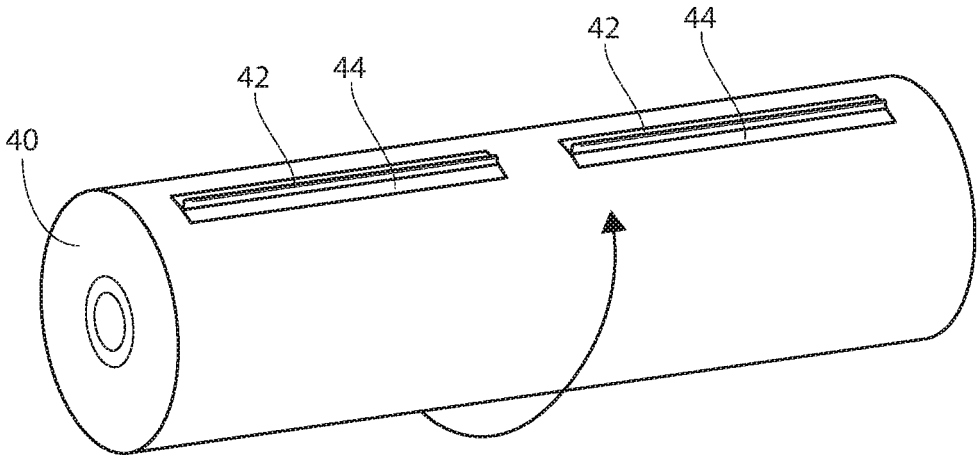
FIG. 7 is a perspective view of a knife roll carrying a pair of knife inserts, each knife insert carrying a knife, with the knife inserts aligned in the machine direction.
Figure 8:
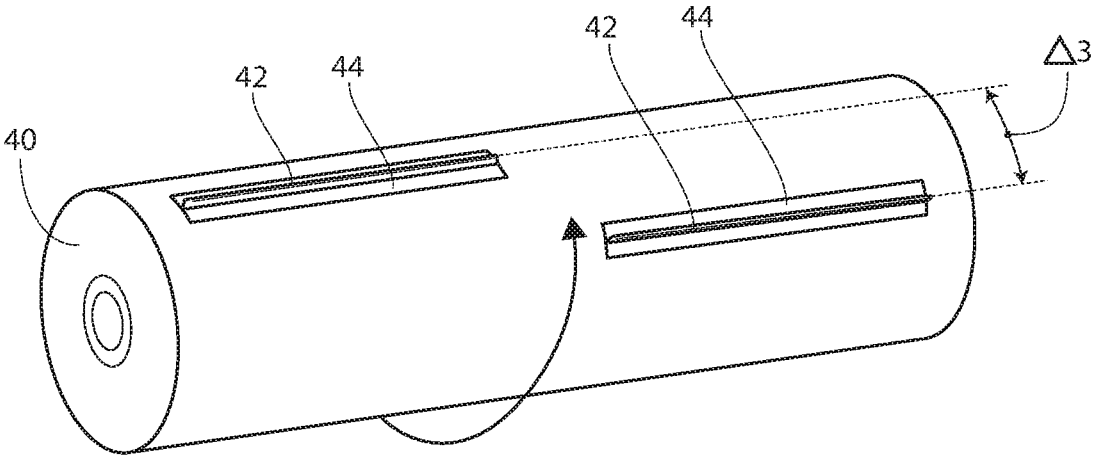
FIG. 8 is a perspective view of a knife roll carrying a pair of knife inserts, each knife insert carrying a knife, with the knife inserts offset in the machine direction.

Referring now to FIG. 7, a perspective view of a knife roll 40 carrying a pair of knife inserts 44 is shown. Knife inserts 44 carry knives 42. An operator side and a drive side knife insert 44 are provided, in order to create the severs in elastic 14, for instance near the side seam cuts 20 of FIG. 1, but preferably between adhesive 12 zones on both the front and rear of the diaper product. In the embodiment shown in FIG. 7, the inserts 44 can be aligned in the machine direction. In contrast and as shown in FIG. 8, the knife inserts 44 can be offset in the machine direction by a distance Δ2 in order to contact the elastics 14 at different times during the manufacturing process, if desired.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. In a system having a revolving compression blade and a revolving anvil cooperating to present a nip, a method comprising the step of:

spacing a revolving compression blade apart from a revolving anvil during a closest passage between said compression blade and said revolving anvil, said closest passage greater than zero, said closest passage defining a nip gap between the compression blade and the anvil during respective revolutions, the nip gap adapted to receive a web material, wherein a sum of the distance between said compression blade axis and said compression blade distal end, and a distance between said anvil axis and said first anvil radius, is less than the distance between said anvil axis and said compression blade axis;

changing said nip gap by at least one of the steps of advancing a sloped working anvil surface relative to said compression blade or advancing said compression blade relative to said sloped working anvil surface; receiving a composite web in the nip gap, the web comprising at least a middle layer disposed between a first layer that contacts the compression blade and a second layer that contacts the anvil; and completely severing the middle layer without severing the first layer and without severing the second layer.

2. An apparatus comprising:

a compression blade for compressing webs of material without cutting, supported for revolution in a first direction about a compression blade axis, said compression blade comprising a distal end of said compression blade;

an anvil supported for revolution in a second direction about an anvil axis, the anvil having a working anvil surface facing away from the anvil axis;

said working anvil surface presenting a first, shorter anvil radius between said working anvil surface and said anvil axis at a first working anvil surface position, and a second, longer anvil radius between said working anvil surface and said anvil axis at a second working anvil surface position;

wherein a sum of the distance between said compression blade axis and said compression blade distal end, and a distance between said anvil axis and said first anvil radius, is less than the distance between said anvil axis and said compression blade axis;

a nip gap variable between a first nip gap spacing comprising a distance greater than zero, and a minimum distance between said compression blade distal end and said first working anvil surface position; and a second nip gap spacing, smaller than said first nip gap spacing, comprising a distance greater than zero, and a minimum distance between said compression blade distal end and said second working anvil surface position;

wherein a sum of a distance between said compression blade axis and said compression blade distal end, and a distance between said anvil axis and said second anvil radius, is less than the distance between said anvil axis and said knife axis, wherein the nip gap is selectively variable by changing a relative rotational position of the compression blade with respect to the first and second working anvil surface positions.

3. An apparatus according to claim 2, wherein the compression blade axis and anvil axis are at least substantially parallel to each other.

4. An apparatus according to claim 2, the anvil surface comprising a working anvil surface length measured tangentially to the second direction, the working anvil surface length extending between a leading end and a trailing end.

5. An apparatus according to claim 4, wherein the compression blade is closest to the anvil axis in the nip position.

6. An apparatus according to claim 5, wherein the working anvil surface is sloped toward the anvil axis from the leading end toward the trailing end.

7. An apparatus according to claim 2, the compression blade having a blade edge extending parallel to the knife axis.

8. An apparatus according to claim 7, the blade edge comprising a cross-section perpendicular to the compression blade axis, the cross-section comprising a radius.

9. An apparatus according to claim 8, the blade edge comprising a radius of about 0.25 mm to about 10 mm to form a rounded working surface.

10. An apparatus according to claim 9, the blade edge comprising a radius of about 0.25 mm to about 6 mm.

11. An apparatus according to claim 2, the first direction and second direction being opposite.

* * * * *